US006427877B1

(12) United States Patent
Trout

(10) Patent No.: US 6,427,877 B1
(45) Date of Patent: Aug. 6, 2002

(54) CORNER BOX

(76) Inventor: Willis Z. Trout, 1124 Siddonsburg Rd., Mechanicsburg, PA (US) 17055

( * ) Notice: Subject to any disclaimer, the term of this patent is extended or adjusted under 35 U.S.C. 154(b) by 0 days.

(21) Appl. No.: 09/741,390

(22) Filed: Dec. 20, 2000

(51) Int. Cl.[7] ..... G01F 11/00
(52) U.S. Cl. ..... 222/386; 425/87
(58) Field of Search ..... 222/386, 386.5; 425/87; 401/137, 171

(56) References Cited

U.S. PATENT DOCUMENTS

| | | | | | |
|---|---|---|---|---|---|
| 1,306,830 | A | * | 6/1919 | Moore | 222/386 |
| 2,313,213 | A | * | 3/1943 | Atherley | 222/386 |
| 2,664,753 | A | * | 1/1954 | Hein | 222/386 |
| 2,889,699 | A | * | 9/1959 | Ames | 222/386 |
| 3,602,405 | A | * | 8/1971 | Ames | 222/386 |
| 4,664,611 | A | * | 5/1987 | Kumar | 222/386 |

OTHER PUBLICATIONS

Brochure—Ames—Tools, Supplies, Service.
Brochure—TapeTech—Why should you be using a TapeTech Automatic Taper and Drywall Finishing System?.
Brochure—Premier Drywall Tool Co.—The New Generation of Drywall Taping Tools.
Brochure—Murco Wall Products, Inc.

* cited by examiner

*Primary Examiner*—William C. Doerrler
*Assistant Examiner*—Stephanie L. Willatt
(74) *Attorney, Agent, or Firm*—Barley, Snyder, Senft & Cohen, LLC

(57) ABSTRACT

The invention is directed to a box for dispensing taping compound to a surface which facilitates the uniform distribution of the taping compound to an applicator head while preventing leakage of the compound. A nozzle extends from a fixed end wall in a direction away from a movable end wall and a compound receiving cavity. A first end of the nozzle is positioned proximate to and cooperates with the cavity. An interior wall of the nozzle has a smooth configuration and a smooth, arcuate transition with the end wall. The top wall and a portion of the nozzle are configured to cooperate with each other so that no shoulder is provided therebetween. The box also has an arcuate recess provided on a bottom wall and a cylindrical portion provided on the movable wall. The arcuate recess and the cylindrical portion are configured to have essentially the same diameter.

18 Claims, 2 Drawing Sheets

CORNER BOX

FIELD OF THE INVENTION

The invention is directed to a tool for dispensing taping compound or the like. In particular, a corner box is disclosed which allows for the smooth and easy flow of the taping compound through an applicator head.

BACKGROUND OF THE INVENTION

Tools for applying taping compounds to walls are well known in the industry. Various of these tools are designed for particular applications. One such tool is referred to as a corner box with an applicator head attached thereto. The corner box, of the type shown in the Premier Drywall Tool Co. catalog entitled The New Generation of Drywall Taping Tools, is configured to provide a reservoir for the taping compound. The corner box is made from metal components which have a dispensing mechanism and a nozzle on which the applicator head is positioned. The corner boxes are used to deliver taping compound into corners of a room or space which are typically difficult to access with other tools.

While these prior-art corner boxes have been beneficial, several problems exist. The flow of the taping compound from the corner box to the applicator head has proven difficult to apply uniformly. The configuration of the nozzle can cause resistance to the flow which thereby result in an uneven flow of the taping compound to the applicator head.

Another problem with the prior-art corner boxes relates to the leaking of the taping compound from areas other than the nozzle. As the dispensing mechanism is pivoted about an axis, the taping compound attempts to flow through the joint created at the axis of pivot. This problem has heretofore been addressed by adding a gasket or other member proximate the axis of rotation which prevents the flow of the taping compound through the joint.

It would be advantageous to provide a corner box which eliminates the above-recited problems. In other words, it would be beneficial to devise a corner box in which the taping compound was dispensed only through the nozzle and at a uniform, continuous flow.

SUMMARY OF THE INVENTION

The invention is directed to a box for dispensing taping compound to a surface which eliminates the problems described above. The box has a compound receiving cavity which has side walls, a top wall, a bottom wall, fixed end wall and a movable end wall. The movable end wall is movable between a first position and a second position. A nozzle extends from the fixed end wall in a direction away from the movable end wall and the compound receiving cavity. A first end of the nozzle is positioned proximate to and cooperates with the cavity. An interior wall of the nozzle has a smooth configuration and a smooth, arcuate transition with the end wall. The top wall and a portion of the nozzle are configured to cooperate with each other so that no shoulder is provided therebetween. As the movable wall is moved from the first position to the second position, the taping compound provided in the cavity will flow easily and evenly out of the cavity through the nozzle with minimal disturbance in the flow of the taping compound.

Another aspect of the invention is also directed to a box in which an arcuate recess is provided on the bottom wall and a cylindrical portion is provided on the movable wall. The arcuate recess and the cylindrical portion are configured to have essentially the same diameter and circumference and are maintained in close relationship as the movable wall in moved between the first and second positions. As the movable wall is moved between the first position and the second position, the arcuate recess and cylindrical portion cooperate to prevent the flow of taping compound from the cavity therebetween.

The box of the invention can have the side walls, the bottom wall, the top wall and the fixed end wall are integrally molded in a single molding operation. The nozzle can also be integrally molded to the fixed end wall.

DETAILED DESCRIPTION OF THE INVENTION

Figure 1:
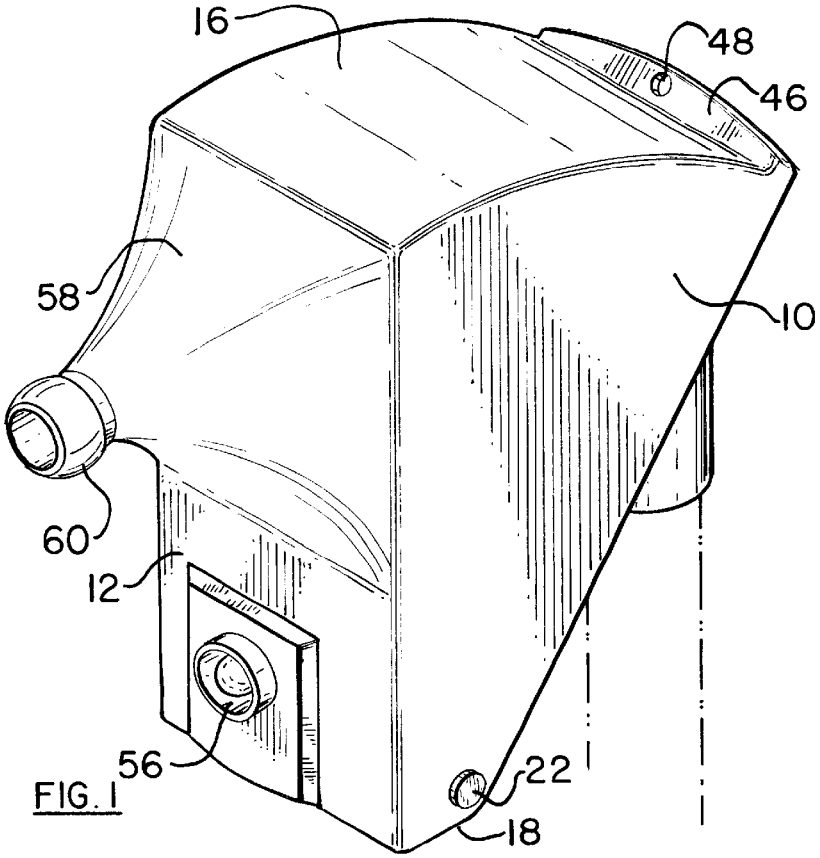
FIG. 1 is a perspective view of an embodiment of a corner box according to the invention disclosed herein.
Figure 2:
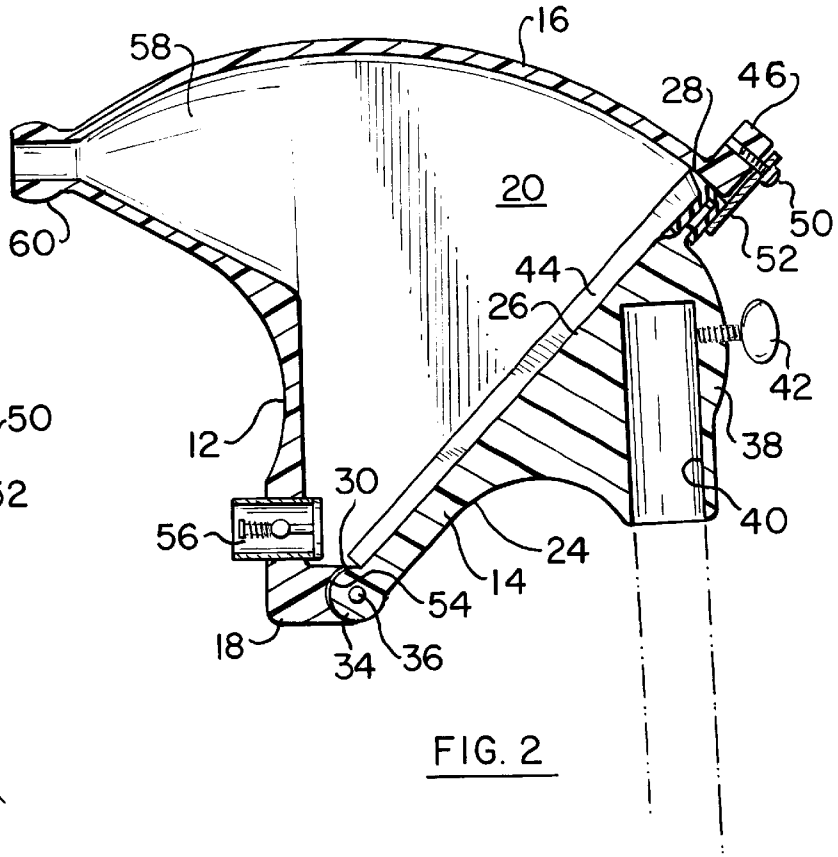
FIG. 2 is a cross-sectional view showing a cavity in which compound is maintained and a movable wall in an open or first position.
Figure 3:
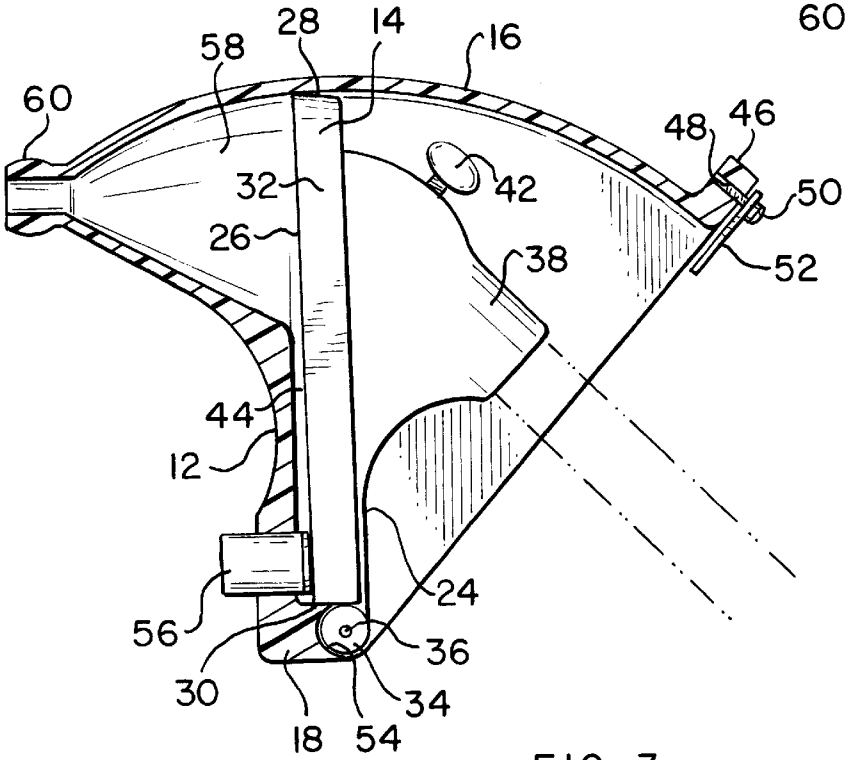
FIG. 3 is a cross-sectional view similar to FIG. 2, showing the movable wall in a second or closed position.

Referring to FIG. 1 through 3, an embodiment of the present invention illustrates a corner box or taping compound dispensing box which has side walls 10, an end wall 12, a movable wall 14, an arcuate top wall 16, and a bottom wall 18. The walls form a cavity 20 (FIG. 3) which is configured to receive compound therein. The compound can be made of various substances and for different uses. In the embodiment disclosed, the compound is a taping or joint compound. The side walls 10, end wall 12, top wall 16, and bottom wall 18 are integrally molded in a single molding operation, which allows the corners or transitions between the various wall to be more arcuate and less severe. This enhances the flow of the taping compound in the cavity and allows for easier clean up of the corner box after the job is complete.

The movable wall 14 is pivotally mounted to the side walls 10 by use of screws 22. The operation of the movable wall 14 will be more fully described below.

The movable wall 14 is molded from the same material as the other walls. As best shown in FIGS. 2 and 3, wall 14 has a first major surface 24 and an oppositely facing second major surface 26. A top edge 28, bottom edge 30, and side edges 32 extend between the major surfaces. A cylindrical portion 34 is provided proximate bottom edge 30. Screw receiving openings 36 are provided at each end of cylindrical portion 34. A handle receiving portion 38 extends from the first major surface 24 in a direction generally away from the second major surface 26. The handle receiving portion 38 has an opening 40 receiving a handle or a pole therein. A locking screw 42 is provided on the handle receiving portion 38. The locking screw 42 cooperates with the handle to maintain the handle in the opening. Rubber sealing members 44 are provided on the top edge 28 and side edges 32. The sealing members can be molded into movable wall 14 or can be removably attached in any number of known ways.

A securing portion 46 of top wall 16 extends upward therefrom, as viewed in FIGS. 1 through 3. The securing portion 46 has an opening 48 extending therethrough for receipt of a screw 50 therein. The screw 50 cooperates a securing latch 52 to the portion 46, such that the securing latch 52 can rotate about screw 50. While securing latch 52 is designed to rotate, the rotation will not occur unless a significant force is applied thereto. This prevents unwanted movement of the securing latch 52.

The bottom wall 18 has an arcuate recess 54 provided thereon. The arcuate recess 54 extends from one side wall to the other. The recess 54 is dimensioned to cooperate with cylindrical portion 34 of movable wall 14. The positioning of recess 54 is in general alignment with screw receiving openings of side walls 10.

End wall 12 has a taping compound receiving port 56 which extends therethrough. The port 56 is of known configuration and allows taping compound to flow inside to cavity 20 when the corner box is used. The port 56 also prevents the unwanted flow of taping compound outward from the cavity 20.

Figure 4:
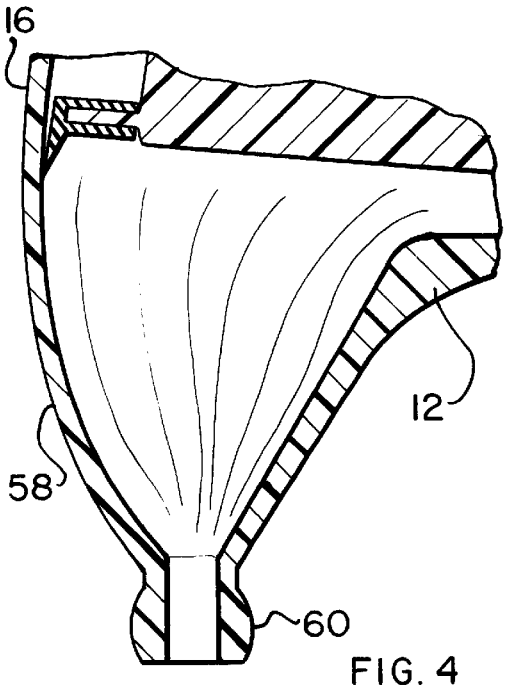
FIG. 4 is a perspective view showing the flow of compound through the nozzle of the present invention.

A dispensing nozzle 58 is provided on end wall 12 and extends in a direction away from cavity 20. The nozzle has a conical-type configuration, with the largest diameter being located on the end wall 12. The interior and exterior wall of the nozzle 58 are generally smooth and have smooth transitions to the end wall 12. No sharp edges or ledges are provided in the nozzle 58. In the embodiment illustrated in the Figures, the nozzle 58 does not have a perfect conical configuration. When viewed in FIG. 4, the top of the cone proximate the end wall 12 is flat rather than round. Consequently, the top wall 16 cooperates directly with the nozzle 58, with no shoulder provided therebetween. No portion of the end wall 12 is provided therebetween. of side walls 10 into screw receiving openings 36 of cylindrical portion 34. Openings 36 may have inserts provided therein to prevent damage to the side walls.

As movable wall 14 is initially moved between side walls 10, the latch 52 is positioned such that no portion of the latch extends below the securing portion 46 of the top wall 16, thereby allowing the movable wall to move into cavity 20. However, once movable wall 14 is positioned between side walls 10, the latch 52 is rotated such that an end of the latch extends downward beyond the securing portion 46 (as viewed in FIG. 2). This position of the latch 52 prevents the movable wall 14 from moving out of engagement with the side walls 10. If the movable wall must be rotated out of engagement with the side walls, the operator can rotate the latch to the initial position described, thereby allowing the movable wall 14 to be moved beyond the side walls 10 and out of cavity 20.

With movable wall 14 maintained between side walls 10, a filling apparatus (now shown) is moved into engagement with the taping compound receiving port 56. The apparatus causes the port 56 to open, thereby allowing the taping compound to be pumped into the cavity 20. As the flow of compound into the cavity occurs, the compound exerts force on the walls. As the walls 10, 12, 16, and 18 are fixed, the pressure associated with the flow of the compound causes the movable wall 14 to be pushed backward toward latch 52 which is in its downward position. The flow of compound continues until the movable wall 14 engages latch 52 and a sufficient volume of compound is provided in the cavity 20 to prevent the further flow of compound therein. Once filled, the filling apparatus is removed from the port 56.

The configuration of the corner box assembly prevents any unwanted compound to flow outside of the cavity. Although the dimensions of the movable wall 14 are slightly smaller than the dimensions of the cavity (at any respective cross-section), the compound is prevented from leaking due to the cooperation of sealing members 44 with the side walls 10 and movable wall 14. As the sealing member operates in a well-known manner, a more detailed explanation will not be provided.

While the sealing member prevents leakage of the compound around the top edge 28 and side edges 32, the bottom edge 30 with the cylindrical portion 34 has previously been prone to leakage. However, in the present invention, the cylindrical portion 34 and the arcuate recess 54 of the bottom wall cooperate to prevent leakage in this area. The cylindrical portion and arcuate recess are designed such that the portion 34 and recess 54 have essentially the same diameter and circumference. This insures that the portion 34 will be maintained in close relationship to the surface of the recess 54 even as the movable wall 14 is moved between the first and second positions. This greatly reduces the possibility of leakage. Also, the fact that no straight path is provided between the cavity 20 and the outside (the path is arcuate), the unwanted flow of compound is minimized.

With the corner box properly filled, the operator uses the corner box with the application head attached to perform the function for which it is designed, apply taping compound to corners and other similar areas during construction, repair remodeling, etc. In so doing, the operator will move the corner box, attached to a handle, into proper position. Once in position, a force is applied to the handle which causes taping compound to be dispensed through the applicator head. During this process, movable wall 14 is moved toward end wall 12. This movement compresses the taping compound, forcing it to flow over the path of least resistance, i.e. through the applicator head and onto the wall. As it is important for the wall 14 to be in close proximity to the walls 10, 16, and 18 during movement, the top wall 16 is configured to essentially duplicate the movement of the top edge 28 of wall 14 as the wall is moved between the first, open position to the second, closed position.

As the movable wall 14 is moved toward end wall 12, forces are applied to the taping compound. These forces are applied because the movement of the movable wall 14 toward end wall 12 reduces the area of the cavity in which the taping compound is housed. The reduction in the area results in the taping compound applying forces to each wall of the corner box, i.e. the taping compound resists compression. Once the movable wall 14 is moved a sufficient distance, the taping compound can effectively no longer compress, causing the taping compound to flow out through the nozzle 58 and the applicator head, as this is the path of least resistance.

In prior art units, the taping compound did not always flow as described. As the bottom walls of respective prior art corner boxes do not have a recess which conforms to the shape of the cylindrical portions, the taping compound may leak through the space or gap provided between the cylindrical portion and the bottom wall. As this space provides the path of least resistance in the prior art boxes, the problem of leakage through the space can cause a significant problem. In some of the prior art corner boxes, a special gasket is added and positioned between the cylindrical portion and the end wall to prevent the leakage. This is expensive and needlessly adds to the complexity of the corner boxes. The flow of the taping compound through the space increases the difficulty to operate the corner box effectively. As taping compound is captured in the space, the ease of movement of the movable wall 14 is impaired. This prohibits the operator from smoothly and evenly manipulating the movable wall, which can result in the uneven distribution of taping compound in the corner or wherever the compound is applied.

While the direction of the flow of the taping compound is controlled as described above, the ease of dispensing the taping compound is greatly facilitated by the shape of the nozzle 58.

Figure 5:
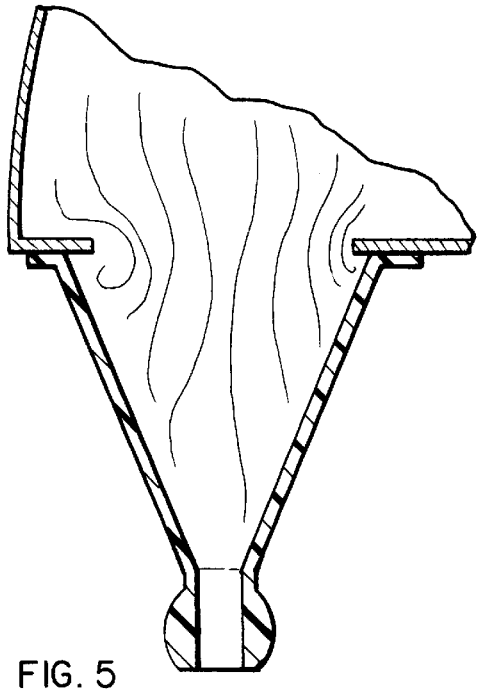
FIG. 5 is a perspective view showing the flow of compound through a prior art nozzle.

As previously stated, the nozzle 58 has a conical configuration which extends away from movable wall 14. The inside surface of the conical nozzle is smooth, with no sharp corners or ledges provided thereon or proximate thereto. In fact, the transition between end wall 12 and nozzle 58 is configured to be somewhat arcuate or rounded in shape. The shape of the transition can be controlled, as the nozzle is integrally molded with the end wall 12. The smooth, even inside surface of the nozzle 58 and the smooth transition between the end wall 12 and the nozzle 58 allows the taping compound to flow freely through the nozzle. This non restricted flow is illustration in FIG. 4. In the prior art, as depicted in FIG. 5, the nozzles have sharp edges and ledges provided thereon. These ledges and sharp edges do not allow the taping compound to flow freely. The taping compound flows differently and less efficiently around these obstacles. Therefore, the operator must apply more force when using the prior art.

In the embodiment shown in the figures, the nozzle 58 does not have a perfect conical shape. When viewed in FIG. 4, the top portion of the nozzle proximate end wall 12 is flat rather than round. This allows the top portion of the nozzle 58 to cooperate directly with the top wall 16. In other words, no ledge or shoulder of end wall 12 is positioned between the top portion of the nozzle 58 and the top wall 16, thereby providing an even transition from the top wall to the nozzle. This further facilitates the smooth, even flow of material previously described.

While the detailed description describes the embodiment of the invention shown in the drawings, modifications can be made without departing from the scope of the invention. The drawings show a corner box in which walls 10, 12, 16, and 18 and the nozzle 58 are molded in one piece. However, the invention applies to other boxes which do not have the walls and the nozzle molded in one piece.

The foregoing illustrates just some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A box for dispensing compound to a surface, the box comprising:

a compound receiving cavity having side walls, a top wall, a bottom wall, a fixed end wall and a movable end wall, the movable end wall being movable between a first position and a second position;

a nozzle extending from the fixed end wall in a direction away from the movable end wall and the compound receiving cavity, a first end of the nozzle is positioned proximate to and cooperates with the cavity, an interior wall of the nozzle has a smooth configuration and a smooth, arcuate transition with the end wall;

the top wall and a portion of the nozzle are configured to cooperate with each other so that no shoulder is provided therebetween;

whereby as the movable wall is moved from the first position to the second position, the compound provided in the cavity will flow easily and evenly out of the cavity through the nozzle with minimal disturbance in the flow of the compound.

2. The box for dispensing compound as recited in claim 1 wherein the nozzle has an essentially conical configuration.

3. The box for dispensing compound as recited in claim 2 wherein the top of the nozzle is essentially flat to conform to the shape of the top wall.

4. The box for dispensing compound as recited in claim 3 wherein the top wall as an arcuate configuration to facilitate the movement of the movable wall between the first and second position.

5. The box for dispensing compound as recited in claim 1 wherein the side walls, the bottom wall, the top wall and the fixed end wall are integrally molded in a single molding operation.

6. The box for dispensing compound as recited in claim 1 wherein an arcuate recess is provided on the bottom wall, the arcuate recess extends from one side wall to the other side wall, and a cylindrical portion is provided on the movable end wall, the arcuate recess and the cylindrical portion are configured to have essentially the same diameter and circumference, such that the arcuate recess and cylindrical portion cooperate to prevent the flow of the compound from the cavity therebetween.

7. The box for dispensing compound as recited in claim 6 wherein rubber sealing members are provided on a top edge and side edges of the movable wall, the rubber sealing members cooperate with the top wall and side walls to prevent the improper flow of compound from the cavity.

8. The box for dispensing compound as recited in claim 1 wherein a securing latch is rotatably mounted to the top wall, the securing latch maintains the movable wall between the first and the second position when the securing latch is in a latching position.

9. A box for dispensing compound to a surface, the box comprising:

a compound receiving cavity having side walls, a top wall, a bottom wall, a fixed end wall and a movable end wall, the movable end wall being movable between a first position and a second position;

an arcuate recess provided on the bottom wall, the arcuate recess extends from one side wall to the other side wall;

a cylindrical portion provided on the movable wall, the arcuate recess and the cylindrical portion are configured to have essentially the same diameter and circumference and are maintained in close relationship as the movable wall is moved between the first and second positions;

whereby as the movable wall is moved between the first position and the second position, the arcuate recess and cylindrical portion cooperate to prevent the flow of compound from the cavity therebetween.

10. The box for dispensing compound as recited in claim 9 wherein the side walls, the bottom wall, the top wall and the fixed end wall are integrally molded in a single molding operation.

11. The box for dispensing compound as recited in claim 9 wherein rubber sealing members are provided on a top edge and side edges of the movable wall, the rubber sealing members cooperate with the top wall and side walls to prevent the improper flow of compound from the cavity.

12. The box for dispensing compound as recited in claim 9 wherein a securing latch is rotatably mounted to the top wall, the securing latch maintains the movable wall between the first and the second position when the securing latch is in a latching position.

13. The box for dispensing compound as recited in claim 9 wherein a nozzle extends from the fixed end wall in a direction away from the movable end wall and the compound receiving cavity, a first end of the nozzle is positioned proximate to and cooperates with the cavity, an interior wall of the nozzle has a smooth configuration and a smooth, arcuate transition with the end wall, whereby as the movable wall is moved from the first position to the second position, compound provided in the cavity will flow easily and evenly out of the cavity through the nozzle with minimal disturbance in the flow of the compound.

14. The box for dispensing compound as recited in claim 13 wherein the top wall and a portion of the nozzle are configured to cooperate with each other so that no shoulder is provided therebetween.

15. The box for dispensing compound as recited in claim 14 wherein the nozzle is integrally molded to the fixed end wall.

16. The box for dispensing compound as recited in claim 14 wherein the nozzle has an essentially conical configuration.

17. The box for dispensing compound as recited in claim 16 wherein the top of the nozzle is essentially flat to conform to the shape of the top wall.

18. The box for dispensing compound as recited in claim 17 wherein the top wall as an arcuate configuration to facilitate the movement of the movable wall between the first and second position.

* * * * *